US007172310B2

(12) United States Patent
Hsu

(10) Patent No.: US 7,172,310 B2
(45) Date of Patent: Feb. 6, 2007

(54) FLASHLIGHT WITH PIVOTAL SWIVEL LIGHT EMITTING ASSEMBLY

(76) Inventor: Huang-Hsi Hsu, 8F., No. 14, Lane 252, Chungshan N. Rd., Sec. 6, Taipei (TW)

( * ) Notice: Subject to any disclaimer, the term of this patent is extended or adjusted under 35 U.S.C. 154(b) by 59 days.

(21) Appl. No.: 10/965,791

(22) Filed: Oct. 18, 2004

(65) Prior Publication Data

US 2006/0082990 A1 Apr. 20, 2006

(51) Int. Cl.
*F21L 4/04* (2006.01)

(52) U.S. Cl. ..... 362/197; 362/199; 362/285; 362/427

(58) Field of Classification Search ..... 362/199, 362/197, 427, 242, 224–225, 202, 195, 277, 362/319, 322, 283, 285
See application file for complete search history.

(56) References Cited

U.S. PATENT DOCUMENTS 3,539,800 A * 11/1970 Doring ..... 362/191
6,366,028 B1 * 4/2002 Wener et al. ..... 315/241 P
6,913,370 B2 * 7/2005 Ping ..... 362/199

* cited by examiner

*Primary Examiner*—Sandra O'Shea
*Assistant Examiner*—Guiyoung Lee
(74) *Attorney, Agent, or Firm*—Bacon & Thomas PLLC

(57) ABSTRACT

The present invention is to provide a flashlight comprising a case, a swivel mount provided on a front end of the case and adapted to turn horizontally along a longitudinal central axis of the case, two opposite first and second arms extended upwardly from the swivel mount farther to the case, and a light emitting assembly pivotally provided between the first and the second arms such that the light emitting assembly is adapted to turn along a transverse axis between the first and the second arms, enabling the light emitting assembly to emit light illuminating any of substantially all regions to the front of the flashlight when both the swivel mount and the light emitting assembly turn appropriately.

16 Claims, 4 Drawing Sheets

FLASHLIGHT WITH PIVOTAL SWIVEL LIGHT EMITTING ASSEMBLY

FIELD OF THE INVENTION

The present invention relates to flashlights and more particularly to such a flashlight having a pivotal light emitting assembly mounted on a swivel mount thereof such that emitted light is adapted to illuminate any of substantially all regions to the front.

BACKGROUND OF THE INVENTION

A conventional flashlight 1 is shown in FIG. 1 and comprises a case 11, an on/off switch 112 provided on an outer surface of the case 11, a bridge 16 provided on an inner surface of the case 11 opposite to the switch 112 and being integrally formed therewith, an internal terminal connecting section 12 provided proximate to a rear of the case 11, a light emitting assembly 13 provided in a head of the flashlight 1, the light emitting assembly 13 including a rear contact 131 distal to the terminal connecting section 12, a bulb 14 provided opposite to the contact 131, a first interconnection 113 provided along the inner surface of the case 11 and having one end slidably coupled to the bridge 16 and the other end fixedly coupled to the terminal connecting section 12, a second interconnection 141 provided along the inner surface of the case 11 and having one end slidably coupled to the bridge 16 and the other end fixedly coupled to the light emitting assembly 13, and a plurality of cells 111 (two are shown) provided between the terminal connecting section 12 and the contact 131 such that sliding the switch 112 toward one direction will enable the bridge 16 to interconnect the first and the second interconnections 113 and 141 and thus enable the cells 111 to supply power to the bulb 14 for emitting light.

However, light emitted from the conventional flashlight 1 is directed to a single direction only. Further, the emitted light is adapted to direct to a desired object by pivoting the wrist to change the path of illumination of the bulb 14 while holding the case 11. In one example, for repairing the machine a worker has to hold the flashlight and direct emitted light toward malfunctioned components of a machine. However, there are many areas of the components to which access is difficult (i.e., dead ends). As a result, it is impossible of illuminating the malfunctioned components due to the single direction of illumination of the flashlight. Thus, it is desirable to provide a novel flashlight having a pivotal light emitting assembly mounted on a swivel mount thereof without modifying the size of the existing flashlight such that emitted light is adapted to sufficiently illuminate any of substantially all regions to the front.

SUMMARY OF THE INVENTION

After considerable research and experimentation, a flashlight having a pivotal light emitting assembly mounted on a swivel mount thereof according to the present invention has been devised so as to overcome the above drawback of the prior art.

It is an object of the present invention to provide a flashlight comprising a case, a swivel mount provided on a front end of the case and adapted to turn horizontally along a longitudinal central axis of the case, two opposite first and second arms extended upwardly from the swivel mount farther to the case, and a light emitting assembly pivotally provided between the first and the second arms such that the light emitting assembly is adapted to turn along a transverse axis between the first and the second arms. By utilizing the present invention, emitted light of the light emitting assembly is adapted to illuminate any of substantially all regions to the front of the flashlight when both the swivel mount and the light emitting assembly turn appropriately.

The above and other objects, features and advantages of the present invention will become apparent from the following detailed description taken with the accompanying drawings.

DETAILED DESCRIPTION OF THE PREFERRED EMBODIMENTS

Figure 4:
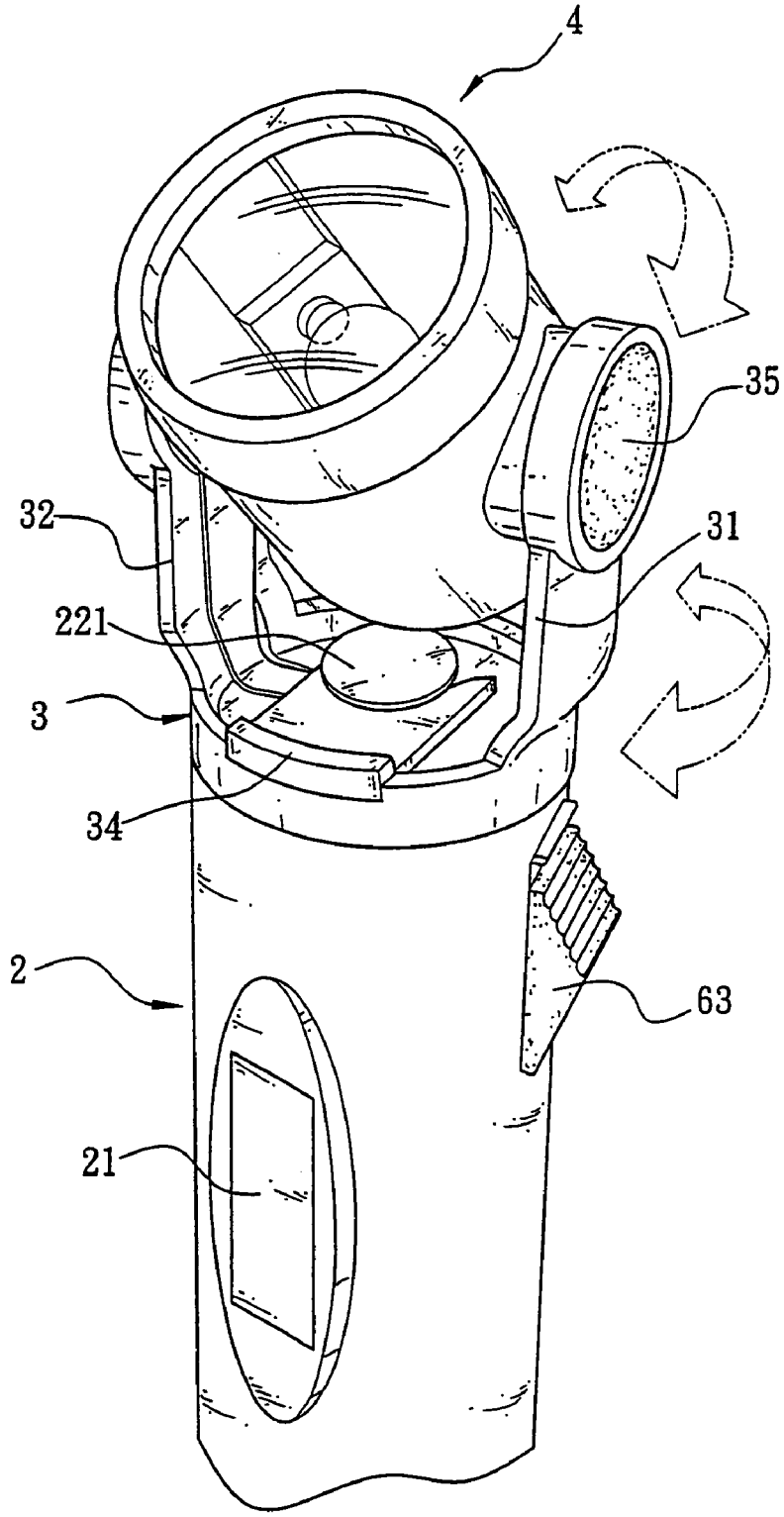
FIG. 4 is a perspective view of the flashlight shown in FIG. 2 for illustrating a pivotal operation of the light emitting assembly and a swivelling operation of the swivel mount respectively.

Referring to FIG. 4, there is shown a flashlight constructed in accordance with a preferred embodiment of the invention comprising a case 2, a swivel mount 3 provided at a front end of the case 2 and being capable of horizontally turning along a longitudinal central axis of the case 2, two opposite first and second arms 31 and 32 extended upwardly from the swivel mount 3 (i.e., farther to the case 2), a light emitting assembly 4 pivotally provided between the arms 31 and 32 (i.e., being capable of turning along a transverse axis (i.e., pivot) between the arms 31 and 32), and a battery assembly 6 inside the case 2 (see FIG. 2), the battery assembly 6 is adapted to supply power to the light emitting assembly 4 for emitting light. This forms the basic construction of the flashlight of the invention. It is envisaged by the invention that emitted light is adapted to illuminate any of substantially all regions to the front of the flashlight when both the swivel mount 3 and the light emitting assembly 4 turn appropriately.

Figure 3:
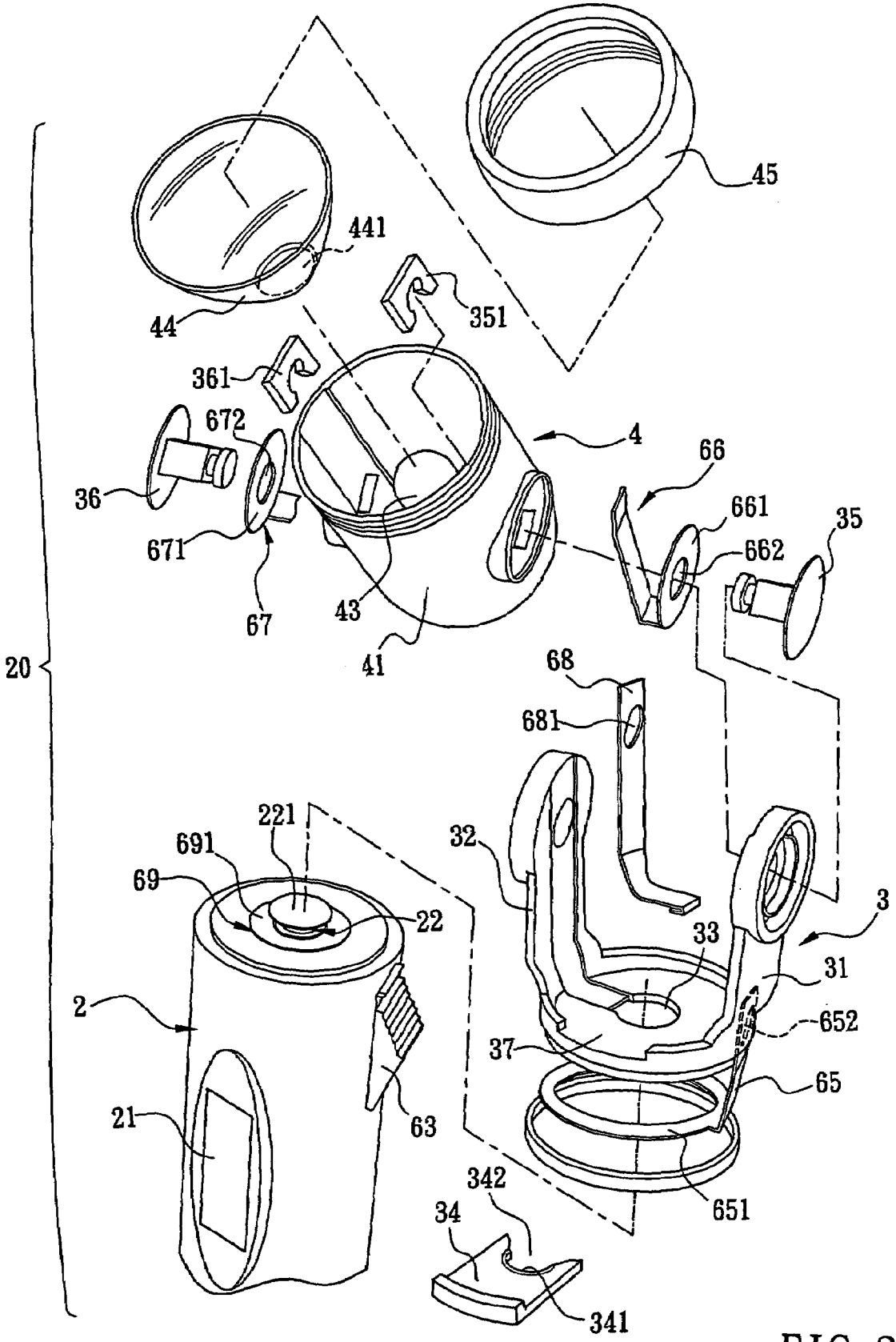
FIG. 3 is an exploded perspective view of the flashlight shown in FIG. 2.

Referring to FIG. 3, there is further provided a pivotal first conductive member 66 provided in the light emitting assembly 4, the first conductive member 66 being coupled to the second arm 32, and a pivotal second conductive member 67 provided in the light emitting assembly 4, the second conductive member 67 being coupled to the first arm 31. That is, the first and the second conductive members 66 and 67 are opposite and each of them has one end extended into about center of the light emitting assembly 4 and the other end extended beyond the light emitting assembly 4. A first contact 65 is provided in the first arm 31 and is extended onto the swivel mount 3 (i.e., at the front end of the case 2) along the first arm 31. A second contact 68 is provided in the second arm 32 and is extended onto the swivel mount 3 (i.e., at the front end of the case 2) along the second arm 32. The first conductive member 66 is electrically coupled to the first contact 65 and the second conductive member 67 is electrically coupled to the second contact 68 when the swivel mount 4 is mounted between the first and second arms 31 and 32.

Figure 1:
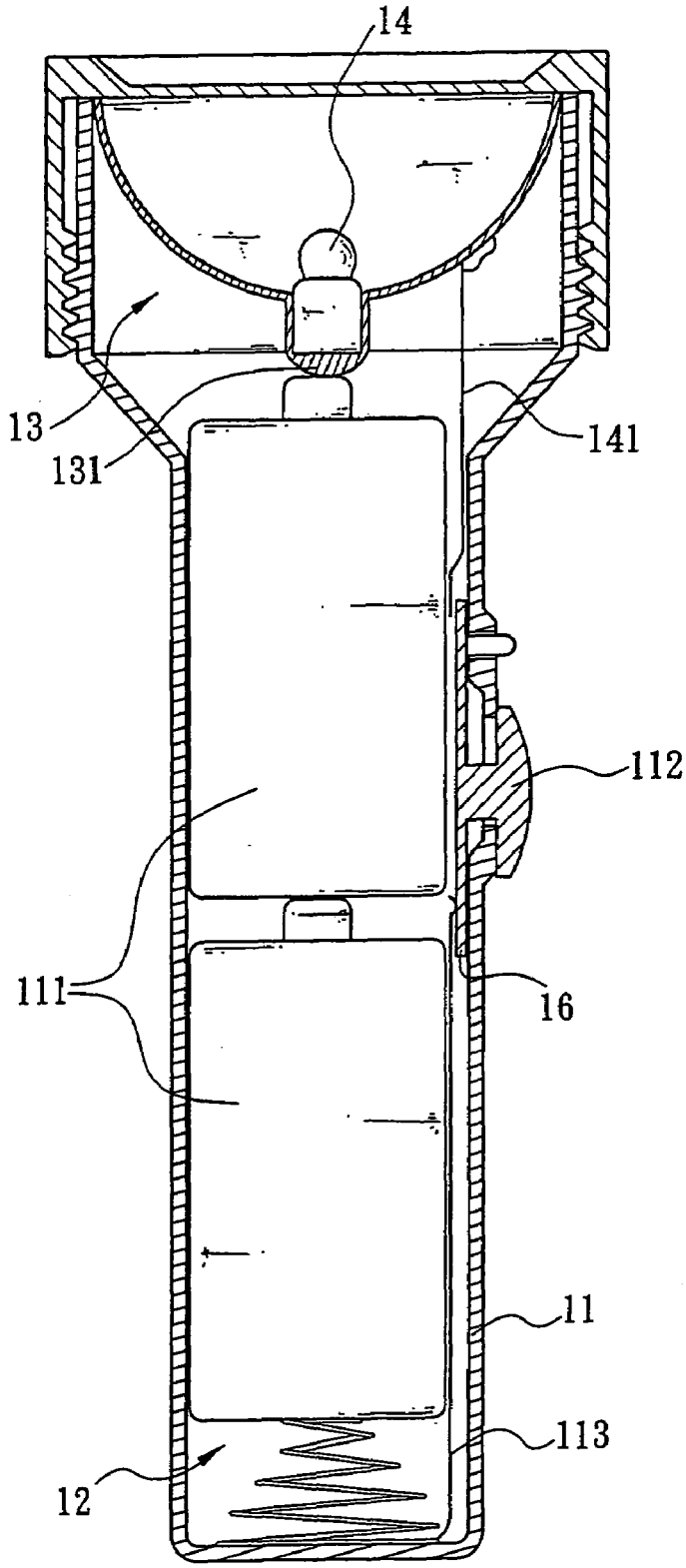
FIG. 1 (Prior Art)
FIG. 1 is a sectional view of a conventional flashlight.
Figure 2:
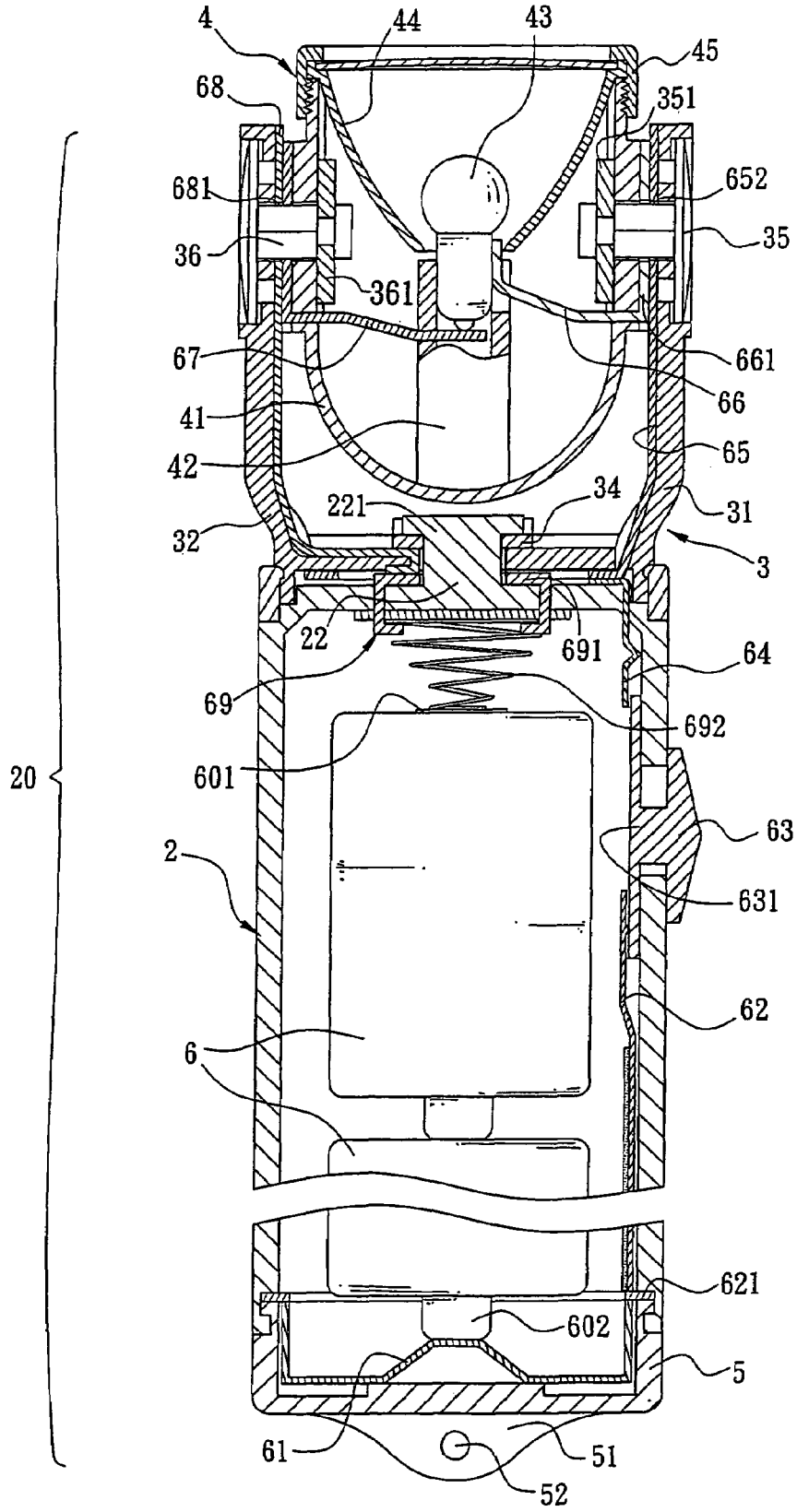
FIG. 2 is a sectional view of a preferred embodiment of flashlight according to the invention.

Referring to FIG. 2, an on/off switch 63 is provided on an outer surface of the case 2, a bridge 631 is provided on an inner surface of the case 2 opposite to the switch 63 and is integrally formed therewith, and a third contact 62 is provided along the inner surface of the case 2 and has one end slidably coupled to the bridge 631 and the other end extended proximate to the rear of the case 2 opposite to the swivel mount 3.

A fourth contact 64 is provided along the inner surface of the case 2 and has one end slidably coupled to the bridge 631 and the other end extended beyond the case 2 proximate to the swivel mount 3. Also, the fourth contact 64 is electrically coupled to the first contact 65. Sliding the switch 63 toward one direction will connect the bridge 631 to the one end of the fourth contact 64 and thus electrically connect the third contact 62 to the fourth contact 64.

Moreover, a fifth contact 69 is provided at the front end of the case 2 proximate to the swivel mount 3. The fifth contact 69 is spaced from the fourth contact 64. The fifth contact 69 has one portion electrically coupled to the second contact 69 and the other portion disposed within the case 2 and electrically coupled to a negative terminal 601 of the battery assembly 6. A cup-shaped cap 5 is provided at the rear of the case 2 distal to the swivel mount 3. A sixth contact 61 is provided on a bottom of the cap 5 inside the case 2 and is electrically coupled to a positive terminal 602 of the battery assembly 6. The sixth contact 61 is electrically coupled to the third contact 62 after mounting the cap 5 onto the rear of the case 2. An external tab 51 having a hole 52 is formed on an underside of the cap 5 (i.e., opposite to the case 2) for connection to a rope or the like.

After electrically connecting the fifth contact 69 to the negative terminal 601 and electrically connecting the sixth contact 61 to the positive terminal 602, slide the switch 63 toward one direction will electrically connect the third contact 62 to the fourth contact 64. A circuit is thus formed by the first conductive member 66, the second conductive member 67, the first, second, third, fourth, fifth, and the sixth contacts 65, 68, 62, 64, 69, and 61. Thereafter, power is supplied from the battery assembly 6 to the light emitting assembly 4. Moreover, turning the swivel mount 3 and/or the light emitting assembly 4 will not disconnect the power supply. That is, the light emitting assembly 4 is able to continuously emit light.

Referring to FIG. 2 again, the light emitting assembly 4 comprises a housing 41 (see FIG. 3), a socket 42 provided on a bottom of the housing 41, the socket 42 being electrically coupled to inner ends of both the first conductive member 66 and the second conductive member 67, a light emitting element 43 (such as a bulb or LED) provided on the socket 42, a concave reflector 44 provided between the mouth of the housing 41 and the socket 42, an opening 441 (see FIG. 3) provided in the bottom of the reflector 44 proximate to the socket 42, the light emitting element 43 being adapted to project from the opening 441 into the reflector 44 such that light emitted by the light emitting element 43 is adapted to reflect in a desired direction by the reflector 44, a transparent ring 45 mounted on the mouth of the housing 41, the ring 45 adapted to protect internal parts thereof, prevent water, carbonate liquid, or the like from entering the housing 41 otherwise a short circuit may occur in the contacts and the light emitting element 43 and may cause damage, and prevent dust or other contaminants from entering the housing 41 otherwise the transmittance of the ring 45 may decrease and thus decrease light emitted by the light emitting assembly 4.

Referring to FIG. 3 again, a central opening 33 is formed on the swivel mount 3. A post 22 is formed on center of the front end of the case 2 and is adapted to insert into the opening 33. In detail, the post 22 is adapted to insert through the opening 33 therebeyond (i.e., beyond the front end of the case 2) when the swivel mount 3 is mounted on the front end of the case 2. A flange 221 is formed on an open end of the post 22. A recess 37 is formed on a periphery of the swivel mount 3. A snapping member 34 is adapted to snugly rest upon the recess 37. The snapping member 34 comprises an inner, curved section 341 and a space 342 defined by the curved section 341 and the post 22. A portion of the post 22 exposed the swivel mount 3 is engaged with the curved section 341 when the snapping member 34 rests upon the recess 37 as a result of the provision of the space 342. Also, the snapping member 34 is anchored between the swivel mount 3 and the flange 221. Turning the swivel mount 3 will cause the post 22 to turn in the opening 33 and the curved section 341 without disengaging the swivel mount 3 from the case 2.

Referring to FIG. 3 again, in the invention first annular members 661 and 671 are formed in the opposite first and second conductive members 66 and 67 respectively. Central openings 662 and 672 are formed on the first annular members 661 and 671 respectively and are adapted to permit snapping elements 35 and 36 to pass through respectively. Inner ends of the snapping elements 35 and 36 are extended beyond the first and the second arms 31 and 32 and are snugly fitted thereon respectively. As a result, the housing 41 is secured to both the first and the second arms 31 and 32. Also, the housing 41 is adapted to turn along a transverse axis between the snapping element 35 and 36. That is, the housing 41 may turn along a pivot between the first and the second arms 31 and 32.

An opening 652 is formed proximate to one end of the first contact 65 and is aligned with the opening 662 and an opening 681 is formed proximate to one end of the second contact 68 and is aligned with the opening 672 respectively. Also, the snapping element 35 and 36 pass the openings 652 and 681 and the openings 662 and 672 of the first annular members 661 and 671 in the first and the second arms 31 and 32 respectively. As such, the first contact 65 is electrically coupled to the first conductive member 66 and the second contact 68 is electrically coupled to the second conductive member 67 respectively. The first annular members 661 and 671 are still electrically coupled to the first and the second contacts 65 and 68 respectively when the light emitting assembly 4 turn along a pivot between the first and the second arms 31 and 32.

The second contact 68 has the other end distal to the second conductive member 67 extended into the swivel mount 3, projected from the opening 33 of the swivel mount 3 in the front end of the case 2, and electrically coupled to the fifth contact 69. Also, the first contact 65 has the other end distal the first conductive member 65 extended into the swivel mount 3, projected from the opening 33 of the swivel mount 3 in the front end of the case 2, and extended around the swivel mount 3 to form an annular second contact piece 651. The first conductive member 65 is thus electrically coupled to the fourth contact 64 via the second contact piece 651. Further, the first contact 65 is not electrically coupled to the second contact 68.

Referring to FIG. 2 again, one end of the third contact 62 proximate to the cap 5 is extended along the inner surface of the case 2 to form an annular third contact piece 621 in the rear of the case 2. The third contact piece 621 has about the same diameter as that of the case 2. The six contact 61 is electrically coupled to the third contact piece 621 when the cap 5 is mounted onto the case 2. As such, power from the battery assembly 6 is adapted to supply to the light emitting element 43 via the positive terminal 602, the sixth contact 61, the third contact 62, the bridge 631, the fourth contact 64, the first contact 65, the first conductive member 66, and the socket 42 (i.e., a first electrical connection). Also, a second electrical connection is formed from the light emitting element 43, the second conductive member 67, the second contact 68, the fifth contact 69, the negative terminal 601, and the battery assembly 6. A complete circuit is formed by both the first and the second electrical connections.

In addition, an end of the fifth contact 69 inside the case 2 is electrically coupled to the negative terminal 601 and the other end thereof external the case 2 is extended around the post 22 to form an annular fourth contact piece 691 (see FIG. 3). One end of the second contact 68 projected from the swivel mount 3 in the front end of the case 2 is electrically coupled to the fourth contact piece 691 when the swivel mount 3 is mounted onto the case 2. The second contact 68 is still electrically coupled to the fifth contact 69 when the swivel mount 3 turns horizontally along a longitudinal central axis of the case 2. A coil spring 691 is provided in the front end of the case 2 opposite to the cap 5 and has one end anchored in the fifth contact 69. The spring 691 is able to fasten the battery assembly 6 in the case 2 and carry out a reliable power supply of the battery assembly 6 to the light emitting assembly 4.

Referring to FIG. 3, in the above embodiment a coupling member 21 is formed on the outer surface of the case 2 for fastening the case 2 onto a flat surface (e.g., machine table, computer case, or the like (not shown)). The coupling member 21 is implemented as a magnet or Velcro type fastener. Correspondingly, the flat surface is made of a magnetically attractive material or is a mating Velcro type fastener for releasably securing the coupling member 21 thereto. After securing the coupling member 21 to a desired member and turning on the flashlight, a user may pivot the light emitting assembly 4 and turn the swivel mount 3 so as to enable emitted light to illuminate any of substantially all regions including dead ends to the front for facilitating an operation being performed.

Referring to FIG. 2 again, the battery assembly 6 comprises one or more cells coupled in series. The light emitting element 43 is implemented as a plurality of LEDs (light-emitting diodes), an argon lamp, a tungsten lamp, or a halogens lamp of high power. Also, power supplied by the battery assembly 6 is sufficient to illuminate the light emitting element 43.

While the invention herein disclosed has been described by means of specific embodiments, numerous modifications and variations could be made thereto by those skilled in the art without departing from the scope and spirit of the invention set forth in the claims.

What is claimed is:

1. A flashlight capable of illuminating any of substantially all regions to the front thereof, comprising:

a case;

a swivel mount disposed on a front end of the case and adapted to turn horizontally along a longitudinal central axis of the case, the swivel mount including a plurality of arms farther to the case;

a light emitting assembly pivotally disposed between the arms;

a battery assembly disposed in the case for supplying power to the light emitting assembly for illumination;

a post formed on a center of the front end of the case projected from the swivel mount;

a third opening formed on the swivel mount and adapted to permit the post to insert thereinto;

a snapping member disposed proximate to the post, the snapping member including an inner, curved section and a space defined by the curved section and the post;

a flange formed on an open end of the post distal to the case, the flange having a diameter larger than that of the inner, curved section; and a recess formed on a periphery of the swivel mount for permitting the snapping member to rest thereupon;

wherein a portion of the post sandwiched between the swivel mount and the flange is engaged with the inner, curved section when the snapping member rests upon the recess in response to mounting the swivel mount on the front end of the case.

2. The flashlight of claim 1, wherein the arms are disposed on two opposite sides of the swivel mount and are comprised of a first arm and a second arm.

3. The flashlight of claim 1, further comprising a cap releasably disposed on a rear end of the case distal to the swivel mount.

4. The flashlight of claim 3, further comprising:

a pivotal first conductive member having one end disposed in the light emitting assembly and the other end coupled to the first arm;

a pivotal second conductive member having one end disposed in the light emitting assembly and the other end coupled to the second arm;

a switch disposed on an outer surface of the case;

a bridge disposed on an inner surface of the case opposite to the switch and integrally formed therewith;

a first contact disposed in the first arm and extended onto the swivel mount at the front end of the case along the first arm and the other end coupled to the pivotal first conductive member;

a second contact disposed in the second arm and extended onto the swivel mount at the front end of the case along the second arm and the other end coupled to the pivotal second conductive member;

a third contact disposed along the inner surface of the case and having one end slidably coupled to the bridge and the other end extended proximate to the rear end of the case opposite to the swivel mount;

a fourth contact disposed along the inner surface of the case and having one end slidably coupled to the bridge and the other end extended beyond the case proximate to the swivel mount to be electrically coupled to the first contact;

a fifth contact disposed at the front end of the case proximate to the swivel mount, the fifth contact having one portion electrically coupled to the second contact and the other portion disposed within the case to electrically couple to a negative terminal of the battery assembly; and a sixth contact disposed on a bottom of the cap inside the case, electrically coupled to a positive terminal of the battery assembly, and electrically coupled to the third contact after mounting the cap onto the rear end of the case.

5. The flashlight of claim 4, wherein the light emitting assembly comprises;

a housing;

a socket disposed on a bottom of the housing, the socket being electrically coupled to inner ends of both the pivotal first conductive member and the pivotal second conductive member inside the light emitting assembly; and a light emitting element disposed on the socket for emitting light in response to being energized by power supplied from the battery assembly.

6. The flashlight of claim 5, wherein the light emitting assembly further comprises:

a concave reflector disposed between the mouth of the housing and the socket, the reflector including a bottom opening proximate to the socket for permitting the light emitting element to project therefrom, and a transparent ring disposed on the mount of the housing.

7. The flashlight of claim 5, further comprising:

two first annular members formed in the pivotal first and the pivotal second conductive members at opposite sides of the light emitting assembly respectively;

two first openings formed on the first annular members respectively;

two second openings formed proximate to one ends of the and the second contacts and being aligned with the first openings respectively;

two snapping elements having one ends passed through the first and the second openings into the housing and the other ends extended beyond the first and the second arms to fit thereon respectively; and two housing snapping members disposed in the housing and secured to the snapping elements in the housing respectively such that the light emitting assembly is adapted to pivotably connect between the first and the second arms.

8. The flashlight of claim 4, wherein the other end of the first contact distal to the pivotal first conductive member is extended to and around the swivel mount at the front end of the case for forming an annular second contact piece.

9. The flashlight of claim 4, wherein the third contact has one end proximate to the cap extended along the inner surface of the case to form an annular third contact piece in the rear end of the case.

10. The flashlight of claim 4, wherein the third contact has one end proximate to the cap extended around the post to form an annular fourth contact piece.

11. The flashlight of claim 4, further comprising a spring disposed in the fifth contact opposite to the cap.

12. The flashlight of claim 1, further comprising a coupling member formed on the outer surface of the case for fastening the case onto an element.

13. The flashlight of claim 12 , wherein the coupling member is a magnet.

14. The flashlight of claim 1, wherein the battery assembly comprises one or more cells.

15. The flashlight of claim 14, wherein the cells are coupled in series.

16. The flashlight of claim 3, further comprising an external tab formed on an underside of the cap opposite to the case, the tab having a hole.

* * * * *